US009889975B2

(12) United States Patent
Van Tassell, III et al.

(10) Patent No.: US 9,889,975 B2
(45) Date of Patent: Feb. 13, 2018

(54) DROPPER WITH A LIGHT

(71) Applicants: Ronald E Van Tassell, III, West Palm Beach, FL (US); Dylan Harrison, West Palm Beach, FL (US); Matthew Paul Lilly, West Palm Beach, FL (US)

(72) Inventors: Ronald E Van Tassell, III, West Palm Beach, FL (US); Dylan Harrison, West Palm Beach, FL (US); Matthew Paul Lilly, West Palm Beach, FL (US)

( * ) Notice: Subject to any disclaimer, the term of this patent is extended or adjusted under 35 U.S.C. 154(b) by 0 days.

(21) Appl. No.: 15/242,385

(22) Filed: Aug. 19, 2016

(65) Prior Publication Data

US 2017/0129661 A1 May 11, 2017

Related U.S. Application Data

(63) Continuation-in-part of application No. 14/855,185, filed on Sep. 15, 2015, now Pat. No. 9,611,080.

(51) Int. Cl.

| | |
|---|---|
| ***B65D 47/18*** | (2006.01) |
| ***B65D 1/08*** | (2006.01) |
| ***B65D 41/04*** | (2006.01) |
| ***F21V 23/04*** | (2006.01) |
| ***F21L 4/00*** | (2006.01) |
| ***F21V 33/00*** | (2006.01) |
| *F21Y 115/10* | (2016.01) |

(52) U.S. Cl.

CPC ..... *B65D 47/18* (2013.01); *B65D 1/08* (2013.01); *B65D 41/04* (2013.01); *F21L 4/00* (2013.01); *F21V 23/0414* (2013.01); *F21V 33/00* (2013.01); *F21Y 2115/10* (2016.08)

(58) Field of Classification Search

CPC B65D 47/18; B65D 1/08; B65D 41/04; F21L 4/00; F21V 33/00; F21V 23/0414; F21Y 2115/10

See application file for complete search history.

(56) References Cited

U.S. PATENT DOCUMENTS 8,336,735 B2 * 12/2012 Kroub ..... B65D 47/18 141/24
2002/0016576 A1 * 2/2002 Lee ..... A61F 9/0008 604/300

* cited by examiner

*Primary Examiner* — David V Bruce
(74) *Attorney, Agent, or Firm* — Clay McGurk; The Law Office of Clay McGurk

(57) ABSTRACT

The present invention provides a dropper having a light that can be switched on and off. The light provides illumination when liquid is being dispensed from a hollow tube of the dropper. The light helps to see how much of the liquid is being dispensed so that liquid would not be wasted.

10 Claims, 5 Drawing Sheets

DROPPER WITH A LIGHT

CROSS-REFERENCE TO RELATED APPLICATIONS

This application is a continuation-in-part of and claims priority to U.S. application Ser. No. 14/855,185 filed Sep. 15, 2015, which is herein incorporated by reference in its entirety.

FIELD OF THE INVENTION

The present invention relates generally to the field of droppers, and more particularly to a dropper having a light that can turn on and off.

BACKGROUND OF THE INVENTION

Droppers are used to move oils and liquids contained inside a bottle to a something else, such as for example, a cartridge of an e-cigarette or other electronic smoking devices. Typically a person removes the dropper from the bottle, compresses the bulb top to draw-up some amount of the liquid inside the hollow tube, and then releases the bulb to dispense the liquid into or onto something else. Sometimes a person wants to count the number of drops being dispensed, so as not to waste the liquid or oil being dispensed. The problem with the current droppers is that it is hard to see the number of drops of liquid being transferred. This is especially true in vape lounges or bars that are darker or have low lighting. This makes it almost impossible to see the e-vape liquid being transferred from a bottle at the vape bar into the e-cigarette. When the oil or liquids are expensive, undue waste is occurring because it is hard to see how much liquid is being dispensed. Therefore, what is needed is a dropper that illuminates so a person can see a liquid or the number of drops of the liquid being transferred.

SUMMARY OF THE INVENTION

The present invention provides a dropper having a light in the top. The light can be turned off and on by pressing a button on the top, on the side, twisting the top or turning a level at the top.

The present invention in one embodiment is a dropper comprising a tube, a dropper bulb connected to one end of the tube, a lighting device partially extending inside the tube, and a cap connected to the tube and the dropper bulb, the cap housing a switch and at least one battery, the cap having a button connected to the switch, the switch connected to the at least one battery and the lighting device.

The present invention in another embodiment is a dropper comprising a hollow tube being tapered on one end, a cap connected to the hollow tube, a dropper bulb connected to the hollow tube, and a button sticking through the cap, a switch connected to the button, at least one battery connected to the switch, and an illumination device connected to the at least one battery.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings. It is to be understood that both the foregoing general description and the following detailed description are exemplary and explanatory and are intended to provide further explanation of the invention as claimed and not to limit it.

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE PREFERRED EMBODIMENT

Figure 1:
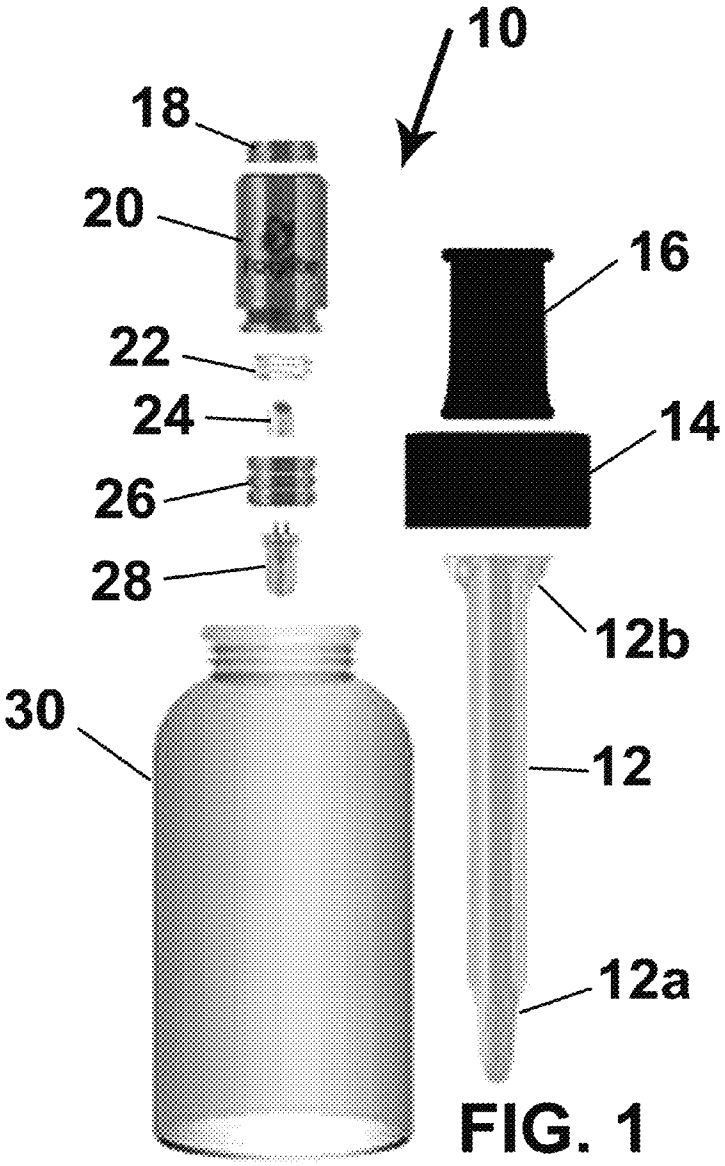
FIG. 1 illustrates a glass dropper with a light in its top according to an embodiment of the present invention.

FIG. 1 illustrates a dropper 10 with a light in its top according to an embodiment of the present invention. The dropper 10 comprises a hollow tube 12, a cap 14, a bulb 16, a button 18, housing 20, a spring 22, an on/off switch 24, batteries 26 and a light bulb 28. The hollow tube 12, cap 14 and the bulb 16 are typically sold together or commercially available either individually or in combination and come in various lengths and styles.

The dropper 10 has a tube (or pipette) 12 which is also known as a Pasteur pipette, a dropper or an eye dropper. The tube 12 when hollow (or solid) is used to transfer small quantities of liquids. The tube 12 can be made of glass or plastic. The tube 12 usually tapers to a narrow point 12*a* as illustrated in FIG. 1. The tapered end 12*a* is used to dispense liquid in droplets. The other end 12*b* of the tube 12 is flared or wider as illustrated in FIG. 1. The tube 12 fits into the cap 14 and is held in place by a bulb 16 which fits into the cap 14. In another embodiment, instead of dropper 10 having a tube 12, a solid (non-hollow) cylindrical piece could be used. The solid piece also would taper at one end 12*a* as shown in FIG. 1 and may also be flared at the other end 12*b*.

In the dropper 10, the inside of the cap 14 has the proper circular dimensions to screw onto the threads on the top or neck of a bottle 30. In other embodiments the cap 14 may not screw but be held by other means known to those skilled in the art. The cap 14 can be made of rubber, plastic or any other suitable material. The cap 14 may also include a plastic or rubber washer (not shown) inside the cap 14, where the washer has a centered hole for holding the tube 12 in place. The tube 12 would be inserted into the washer from the top of the cap 14, where the tapered end 12*a* of the tube 12 would extend through the washer, and the flared top 12*b*

(which is wider or larger than the hole or opening in the washer) of the tube 12 would fit onto the washer, holding it in place inside the cap 14.

The bulb 16 is flexible material, usually made of rubber, plastic or any other material. Bulb 16 is hollow, and is the portion of the dropper 10 that is used when it is compressed, via suction draws liquid inside the hollow tube 12. One end of the bulb 16 fits over the flared top 12*b* of hollow tube 12.

In the top of the bulb 16 is a housing 20. Housing 20 is the area used for storing the parts of the light for illuminating the tube 12 of dropper 10. The top of the housing 20 has a button 18 that can be pressed or tapped to turn the light bulb 28 on or off. In another embodiment, a rubber piece (or other material) may fit over the button 18 and the some or all the housing 20. In another embodiment, button 18 can be replaced with a twist device, whereby the twist device could be twisted to either turn on or off the light 28. In some embodiments, housing 20 and the bulb 16 can be the same piece.

The parts of the lighting system are held inside the housing 20 and comprise a spring 22, a switch 24, a battery 26, and a light or a LED 28. The button 18 at the top of the housing 20 connects to the spring 22. The spring 22 connects to the switch 24. One side of the battery 26 connects to the switch 24, and on the other side of the battery 26 connects to the light 28.

In one embodiment, the button 18 can be used. The spring 22 is a metal piece and is used to turn switch 24 on and off. Switch 24 is commercially available and is a switch that turns the light 28 on and off when the switch 24 is compressed. Battery 26 comprises at least one commercially available mini-battery, although a group or set of similar commercially available batteries can be stacked on top of each other in other embodiments. Light bulb 28 is a LED (light-emitting diode) or something similar, and is used to illuminate the tube 12 of the dropper 10 when it is turned on. The light bulb 28 connects to the batteries 26 and is held in place and inside the top of the tube 12 using a base that is flat and has connection points. This base has holes for where the light bulb 28 would be inserted into the base, where the holes have silicon (or similar material) that connects the outlets on the light 28 to the batteries 26. In an embodiment, light bulb 28 partially extends inside the tube 12 past the end of the cap 14 to provide greater illumination to tube 12.

Figure 2:
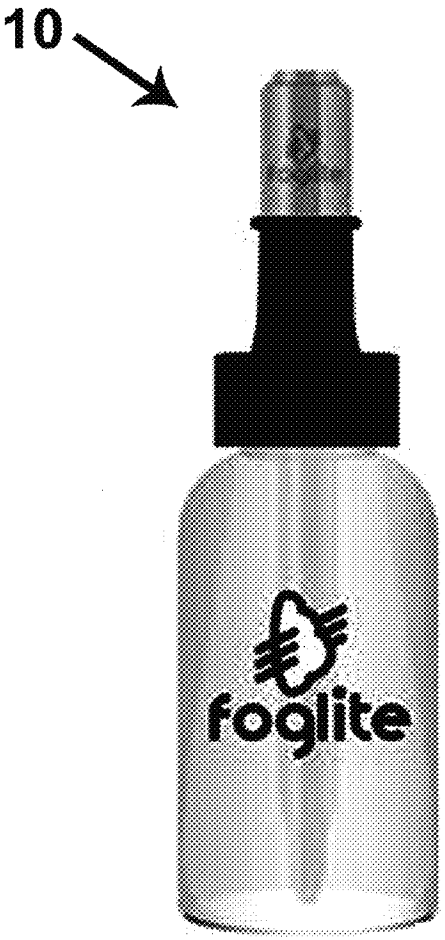
FIG. 2 illustrates a fully assembled dropper according to an embodiment of the present invention.

The bottle 30 is a container that stores or holds oil, liquid or some other material or liquid. Bottle 30 is commercially available and normally has threads at the top or on the neck so that the cap 14 can be screwed onto the bottle, such as illustrated in FIG. 2. The tube 12 is inserted into the bottle and into the liquid, if there is any liquid being stored inside the bottle 30.

The parts of the lighting system are housed or held inside housing 20 where the light 28 of housing 20 could partially extend inside the tube 12 from the bottom edge of the cap 14. However, in other embodiments, the parts of the lighting system could be housed or held inside the bulb 16 instead of the housing 20, or the bulb 16 and housing 20 could be one part instead of two parts. In other embodiments, some of the lighting parts could be housed inside both the bulb 16, while other lighting parts could be housed inside the housing 20. The present invention is intended to cover all different locations and combinations of where the lighting system could be housed in dropper 10.

Figure 3:
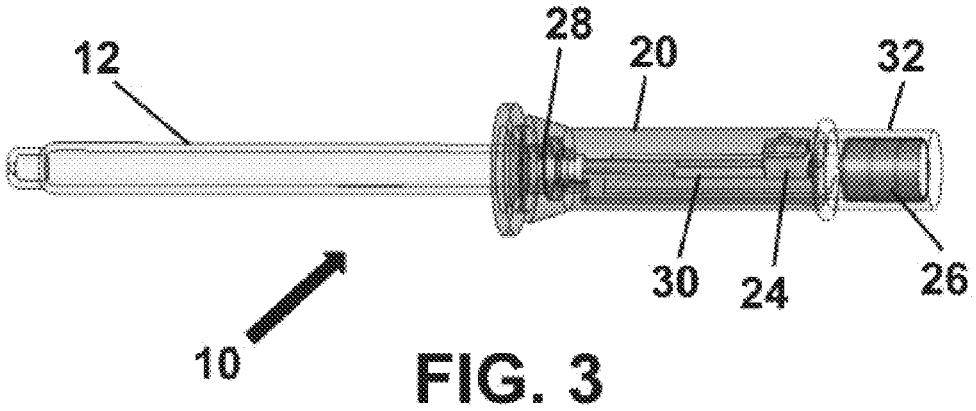
FIG. 3 illustrates a schematic view of a dropper according to an embodiment of the present invention.

FIG. 3 illustrates a schematic view of a dropper according to an embodiment of the present invention. In this embodiment, there is a connector strip 30 that connects the switch 24 to the light bulb 28. The connector strip 30 is similar to a circuit-board switch where a plastic base (or other suitable material known to those skilled in the art) has a strip of silicon or other electrical-conducting material that conducts electricity from the batteries 26 through the switch 24 to the light bulb 28 to turn the light on or off. The switch 24 in this embodiment is commercially available and has a button 25 located on the top. To turn the switch 24 on or off, the housing 20 is made from plastic (or other suitable material known to those skilled in the art) where it can be pressed at a certain location to push the button 25 located on the top of the switch 24. The switch button 25 is shown in later figures described below. In some embodiments, the light bulb 28 extends beyond the housing 20 pass the end of the cap into the inside of the tube 12 to provide greater illumination.

The three batteries shown in FIG. 3 are housed in a battery cap 32. When the cap 32 is placed on the top of the housing 20, the batteries 26 also connect to the connector strip 30 at one end. The battery cap 32 can be removed from the housing 20 by pulling or unscrewing it. The inside of the battery cap 32 can have the notches for screwing to the top of the housing 20 so that the cap 32 is securely fastened to the housing 20 especially when dropper 10 is being moved or used.

Figure 4:
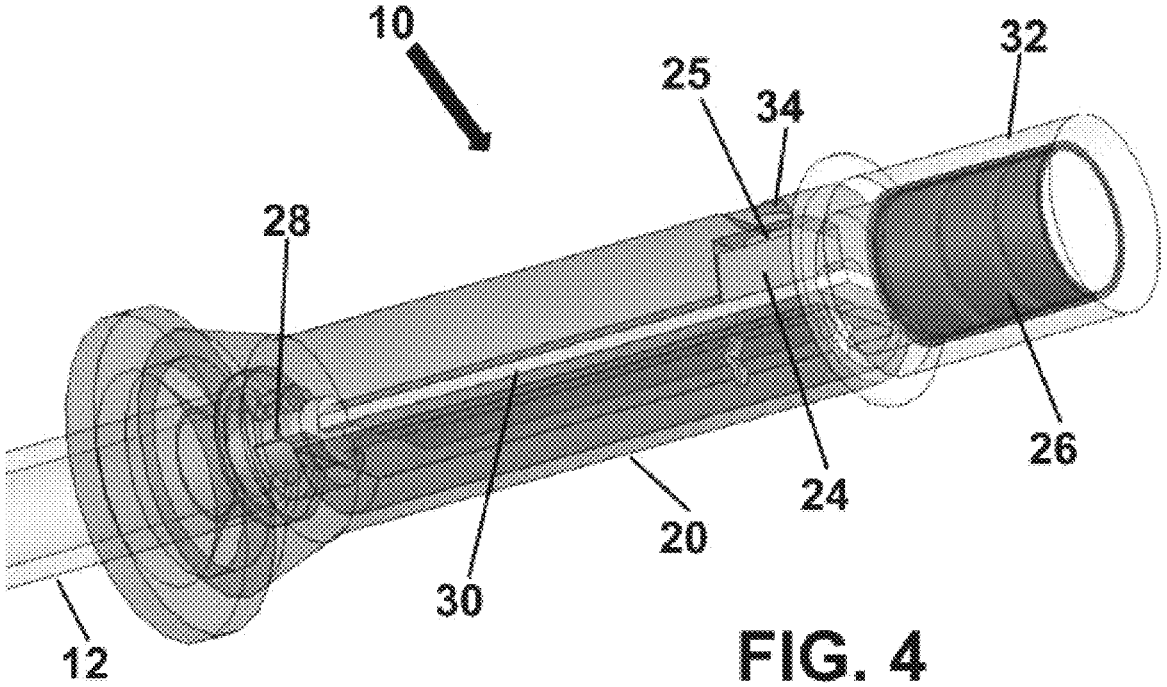
FIG. 4 illustrates a perspective, schematic view of a dropper according to an embodiment of the present invention.

FIG. 4 illustrates a perspective, schematic view of a dropper according to an embodiment of the present invention. This view also shows the dropper 10 where the housing 20 comprises the switch 24 (having a button 25), where the switch 24 is connected to a connector strip 30. One end of the connector 30 strip connects to the batteries 26 (when the cap 32 is attached to the housing 20). The other end of the connector 30 connects to the light bulb 28. The button 34 (which is manufactured into the housing 20) makes contact with the button 25 when it is pressed to turn the light switch 24 on and off. When the switch 24 is on, an electric current flows from the batteries 26 along one end of the connector strip 30 to a terminal in the switch 24, then through the switch 24 to another terminal on switch 24 that connects to the connector strip 30 and eventually to the light bulb 28. The light bulb 28 is attached to the other end of the connector strip 30. In some embodiments, the connector strip 30 could be extended so that the light bulb 28 extends partially into the inside of the tube 12.

Figure 5:
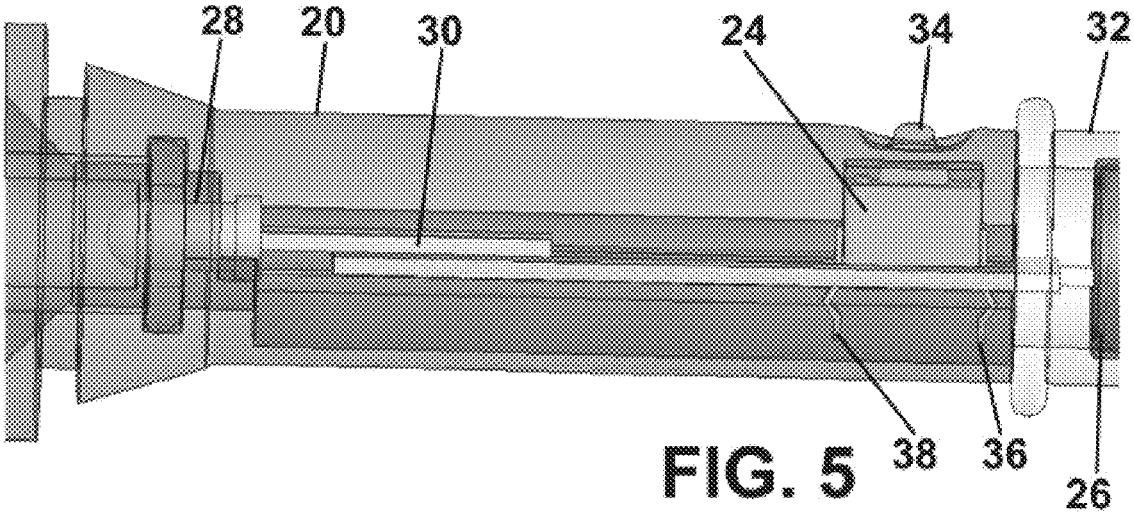
FIG. 5 illustrates a side, schematic view of a dropper according to an embodiment of the present invention.

FIG. 5 illustrates a side, schematic view of a dropper according to an embodiment of the present invention. FIG. 5 shows the terminals 36, 38 of the switch 24 that are connected to the connector strip 30. In FIG. 5, connector strip 30 is shown as two pieces sandwiched together, although one piece could be used as well. The button 34 that is built into housing 20 is separated from the button 25 of switch 24. The button 34 can be formed of the same material as housing 20, or another suitable material known to those skilled in the art.

Figure 6:
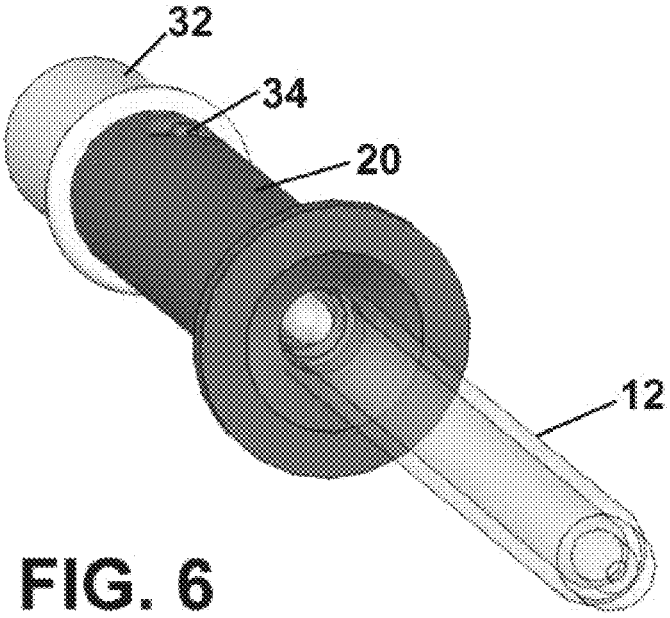
FIG. 6 illustrates a front view of a dropper according to an embodiment of the present invention.

FIG. 6 illustrates a front view of a dropper according to an embodiment of the present invention where the cap 32 (that stores the batteries) is attached to the housing 20, and where the housing 20 connects to the tube 12. The button 34 is located on the outside of the housing 20 where there is an indentation between button 34 and the rest of the housing 20.

Figure 7:
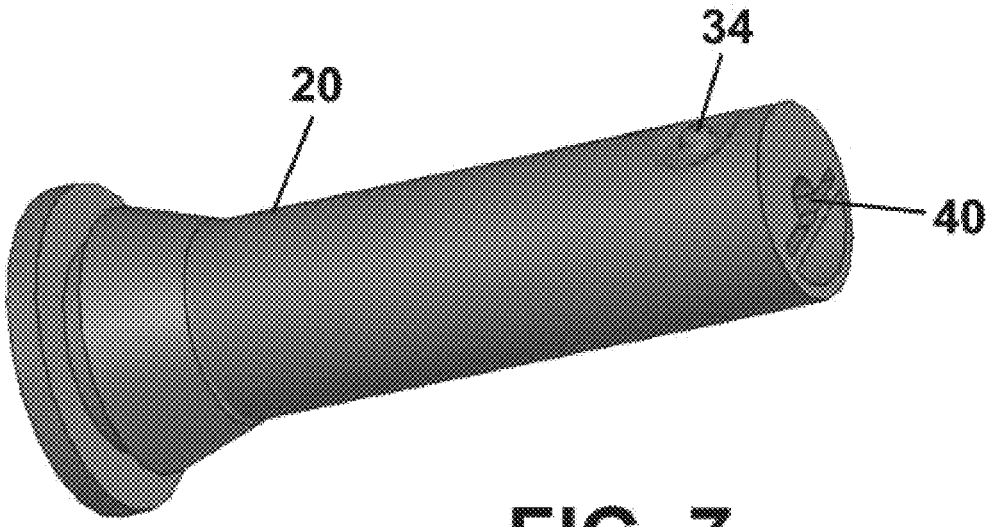
FIG. 7 illustrates a view of a dropper bulb according to an embodiment of the present invention.

FIG. 7 illustrates a view of the housing 20 without battery cap 34 according to an embodiment of the present invention. In FIG. 7, the housing 20 shows the button 34 and an opening 40 at one end of the housing 20. This opening 40 is where the connector strip 30 contained inside would protrude from the housing 20 (not shown). When the battery cap 32 is attached to the housing 20, the connector strip 30 would make contact with the batteries 32 stored inside the cap 32. In alternative embodiments, a connector strip could be attached to the cap 32, and then when the cap 32 is attached to the housing 20, the connector strip would make contact to the connector strip 30 located inside the housing 20.

Figure 8:
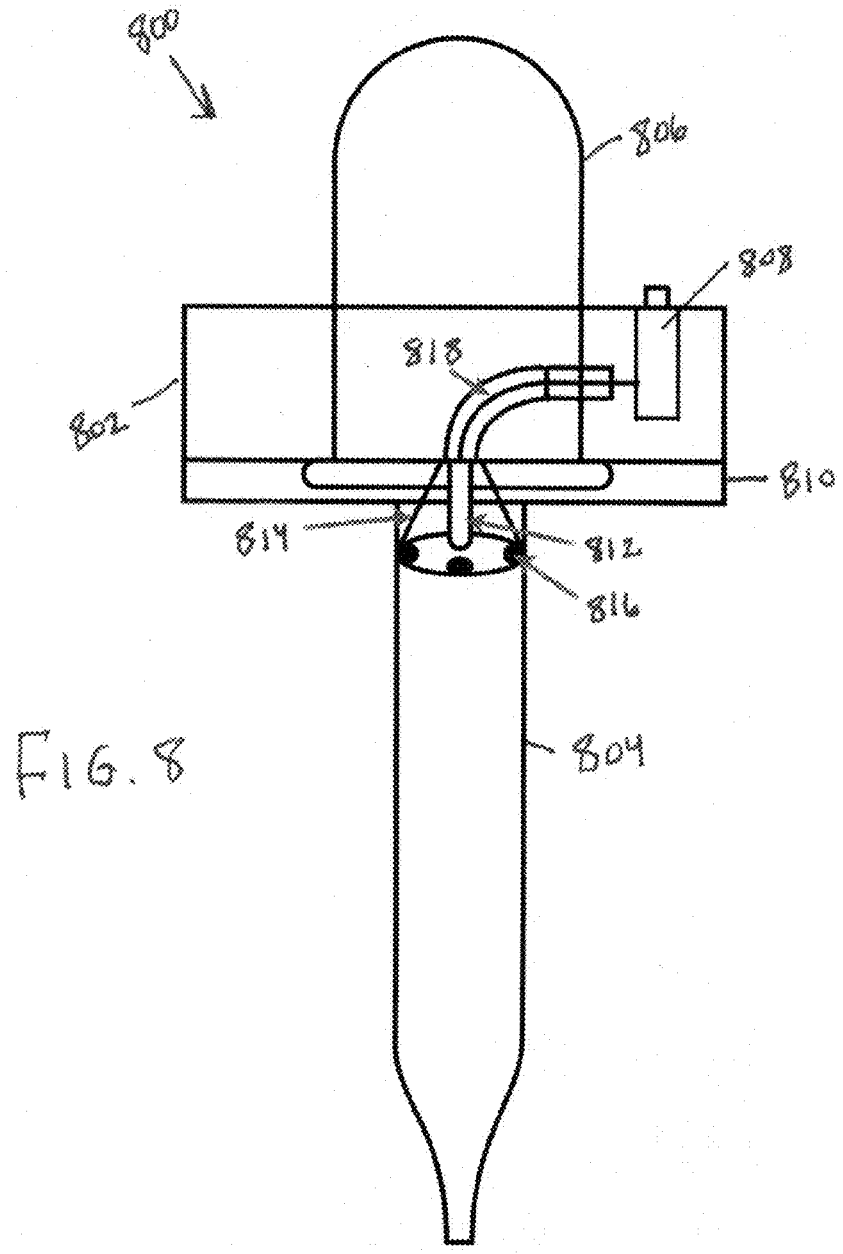
FIG. 8 illustrates a view of a dropper according to an embodiment of the present invention.

FIG. 8 illustrates a view of a dropper according to an embodiment of the present invention. Dropper 800 comprises a hard cap 802, tube or pipette 804, light bulb or LED 806, power switch 808, child-proof or child-safety lock 810, LED or light bulb 812, plastic housing 814 for the light 812, air holes 816 in the tube 804 and wiring 818 from the light bulb 812 to the power switch 808. In this embodiment, the light bulb or LED 812 partially extends beyond the cap 812 into the inside of the tube 804.

Figure 9:
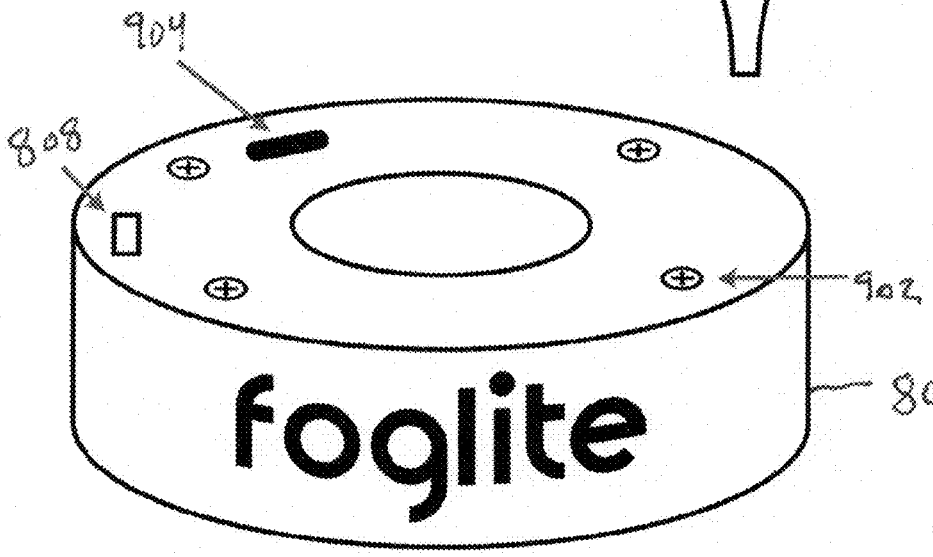
FIG. 9 illustrates a view of a dropper cap according to an embodiment of the present invention.

The hard cap 802 illustrated in FIGS. 8 and 9 is shaped as a donut, where the circular portion surrounds the bulb 806 of dropper 800. The cap 802 can be made of any material, such as aluminum or plastic. The cover of the cap 802 is held by one or more screws 902 that screw the top onto the body of the cap 802. The bottom of the cap 802 can optionally attach to a child safety lock 810, where the child safety lock attaches around the bottom of the dropper bulb 806 as illustrated in FIG. 8.

The tube or pipette 804 is similar to those previous described. At the top of the tube, a plastic housing 814 is made for housing light bulb or LED 812, so that the light bulb 812 partially or fully extends into the tube 804. The extension of the light bulb 812 into the tube 804 provides better illumination to the tube 804 and liquid that may be temporarily stored therein. The housing 814 can be made of plastic or any other material. The housing 814 is shaped in a triangular shape, and attaches to or connects to the bottom of the cap 802 as illustrated in FIG. 8. There are air holes 816 at the perimeter of the housing 814 so that a vacuum can be created by squeezing the dropper bulb 806, thereby drawing liquid into the pipette 804. In other embodiments, the housing 812 could be shaped around the light, thereby eliminating the air holes because the housing 812 and LED light 812 would have a pocket surrounding the housing 812 from the pipette 806.

The light bulb 806 can be an LED or any other type of bulb suitable for this dropper 800. The light bulb 806 can be extended in the vertical direction into the tube 804 (as shown in FIG. 8) or may be aligned in the horizontal direction. The LED may be a single color or be able to change to different colors. A switch for controlling the colors is not illustrated, but can be attached to the cap 802 similar to how the power switch 808 is attached. By clicking the LED switch, one can switch the LED to clear or white light, and with other clicks, switch the LED to a select color or set the switch to alternate between different colors.

The push button on power switch 808 is provided at the top of cap 802. The power switch 808 is connected via wiring 818 to LED light 812. By pushing and releasing the push button, the power switch 808 will turn LED light 812 on and off. In an alternative embodiment, power switch 808 could be combined with the switch for changing the color of the LED light 812, so that by pushing and releasing the push button, the LED light 812 can be turned on and off, and the color of the LED light 812 can be selected.

FIG. 9 illustrates a view of a dropper cap according to an embodiment of the present invention. The push button of power switch 808 is shown on the top of the cap 802. Although the screws 902 attach at the top to hold the top of the cap to the body of the cap in place, screws 902 could be alternatively located on the sides or the bottom. An outlet for a micro-USB charging port 904 is provided at the top of the cap 802 so that lithium or other chargeable batteries (which are housed in cap 802 (or in dropper bulb 806) can be recharged. The batteries that power the LED light 812 can be recharged by using the charging port 904 in dropper 800. In alternative embodiments, the charger port 904 could be replaced with a recharger that recharges the batteries via a charging pad. By placing the cap 802 on a charging pad, the batteries would be recharged.

While the invention has been described in detail and with reference to specific embodiments thereof, it will be apparent to those skilled in the art that various changes and modifications can be made therein without departing from the spirit and scope thereof. Thus, it is intended that the present invention cover the modifications and variations of this invention provided they come within the scope of the appended claims and their equivalents.

What is claimed is:

1. A dropper comprising:
a tube;
a dropper bulb connected to one end of the tube;
a lighting device partially extending inside the tube; and
a cap connected to the tube and the dropper bulb, the cap housing a switch and at least one battery, the cap having a button connected to the switch, the switch connected to the at least one battery and the lighting device.

2. The dropper as in claim 1, further comprising a bottle having at least one thread and capable of being connected to the cap.

3. The dropper as in claim 1, wherein the tube is hollow and is flared on one end and is tapered on the other end.

4. The dropper as in claim 1, wherein lighting device is an LED, and when the button is pressed, the switch turns the LED on or off.

5. The dropper as in claim 1, wherein the cap has a charging port for charging the at least one battery.

6. The dropper as in claim 1, wherein cap has one or more screws to hold a top of the cap to a body of the cap.

7. The dropper as in claim 1, further comprising a safety lock connected to the bottom of the cap.

8. A dropper comprising:
a hollow tube being tapered on one end;
a cap connected to the hollow tube;
a dropper bulb connected to the hollow tube; and
a button sticking through the cap;
a switch connected to the button;
at least one battery connected to the switch;
an illumination device connected to the at least one battery; and
a bottle having at least one thread, wherein the cap is capable of connecting to the cap.

9. A dropper as in claim 8, wherein the illumination device is an LED.

10. The dropper as in claim 8, wherein the screw cap connects to the threads of the bottle.

* * * * *